US009018510B2

(12) United States Patent
Yoshihama

(10) Patent No.: US 9,018,510 B2
(45) Date of Patent: Apr. 28, 2015

(54) MUSICAL INSTRUMENT, METHOD AND RECORDING MEDIUM

(71) Applicant: Casio Computer Co., Ltd., Shibuya-ku, Tokyo (JP)

(72) Inventor: Yuki Yoshihama, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 286 days.

(21) Appl. No.: 13/768,924

(22) Filed: Feb. 15, 2013

(65) Prior Publication Data

US 2013/0239782 A1 Sep. 19, 2013

(30) Foreign Application Priority Data

Mar. 19, 2012 (JP) ..... 2012-061880

(51) Int. Cl.

| | |
|---|---|
| ***G10H 1/06*** | (2006.01) |
| ***G10H 7/00*** | (2006.01) |
| ***G10H 1/00*** | (2006.01) |

(52) U.S. Cl.

CPC ..... *G10H 7/00* (2013.01); *G10H 1/0008* (2013.01); *G10H 2220/096* (2013.01); *G10H 2220/106* (2013.01); *G10H 2220/455* (2013.01); *G10H 2230/281* (2013.01)

(58) Field of Classification Search

CPC ..... G10H 2220/525; G10H 1/348; G10H 1/0058; G10H 3/26; G10H 2220/395; G10H 2240/211; G10H 2220/521; G10H 2220/135; G10H 2210/091; G10H 2220/206; G10H 2210/066; G10H 1/20; G10H 2220/401; G10H 2220/391; G10H 3/00

See application file for complete search history.

(56) References Cited

U.S. PATENT DOCUMENTS

| | | | | |
|---|---|---|---|---|
| 5,177,311 | A * | 1/1993 | Suzuki et al. | 84/600 |
| 5,290,964 | A * | 3/1994 | Hiyoshi et al. | 84/600 |
| 8,586,853 | B2 * | 11/2013 | Sakazaki | 84/743 |
| 2006/0144212 | A1 * | 7/2006 | Hofmeister et al. | 84/724 |
| 2007/0265104 | A1 * | 11/2007 | Haga et al. | 473/37 |
| 2007/0270217 | A1 * | 11/2007 | Rabin | 463/37 |

(Continued)

FOREIGN PATENT DOCUMENTS

| | | | |
|---|---|---|---|
| JP | 2004-252149 | A | 9/2004 |
| JP | 3599115 | B2 | 12/2004 |
| JP | 2011-128427 | A | 6/2011 |

OTHER PUBLICATIONS

U.S. Appl. No. 13/768,889; First Named Inventor: Yuki Yoshihama; Title: "Musical Instrument, Method and Recording Medium", Filed: Feb. 15, 2013:.

(Continued)

*Primary Examiner* — Marlon Fletcher

(74) *Attorney, Agent, or Firm* — Holtz, Holtz, Goodman & Chick PC

(57) ABSTRACT

At a timing at which a music playing operation is made by way of a music playing member, it is determined whether the position coordinates of the music playing member belong to any of a plurality of regions arranged on a virtual plane based on layout information store in memory, and in a case of having determined as belonging to the region, it is determined whether the pitch angle of the music playing member detected by way of a pitch angle sensor belongs to the pitch angle range corresponding to the region, and in the case of having determined as belonging to the pitch angle range corresponding to the region, the generation of a sound of a musical note corresponding to the region is instructed.

15 Claims, 12 Drawing Sheets

(56) References Cited

U.S. PATENT DOCUMENTS

| | | | | |
|---|---|---|---|---|
| 2008/0311970 | A1* | 12/2008 | Kay et al. | 463/7 |
| 2012/0006181 | A1* | 1/2012 | Harada et al. | 84/600 |
| 2012/0137858 | A1* | 6/2012 | Sakazaki | 84/723 |
| 2012/0152087 | A1* | 6/2012 | Sakazaki | 84/600 |
| 2012/0216667 | A1* | 8/2012 | Sakazaki | 84/725 |
| 2013/0047823 | A1* | 2/2013 | Tabata | 84/639 |
| 2013/0152768 | A1 | 6/2013 | Rapp | |
| 2013/0239780 | A1* | 9/2013 | Tabata | 84/602 |
| 2013/0239781 | A1 | 9/2013 | Yoshihama | |
| 2013/0239783 | A1* | 9/2013 | Tabata et al. | 84/609 |
| 2013/0239784 | A1* | 9/2013 | Tabata | 84/609 |
| 2013/0239785 | A1* | 9/2013 | Tabata | 84/609 |
| 2013/0255476 | A1* | 10/2013 | Sakurai et al. | 84/723 |
| 2013/0262021 | A1* | 10/2013 | Sakurai et al. | 702/141 |
| 2013/0262024 | A1* | 10/2013 | Sakurai et al. | 702/150 |

OTHER PUBLICATIONS

Japanese Office Action dated Feb. 4, 2014 in counterpart Japanese Application No. 2012-061880.

* cited by examiner

MUSICAL INSTRUMENT, METHOD AND RECORDING MEDIUM

This application is based on and claims the benefit of priority from Japanese Patent Application No. 2012-61880, filed on Mar. 19, 2012, the content of which is incorporated herein by reference.

BACKGROUND OF THE INVENTION

1. Field of the Invention

The present invention relates to a musical instrument, method and recording medium.

2. Related Art

Conventionally, musical instruments have been proposed that generate musical notes in response to music playing movements, when music playing movements of a player are detected. For example, a musical instrument has been known that generates percussion instrument sounds with only a stick-shaped member. With this musical instrument, when a stick-shaped member equipped with sensors is held by hand and a music playing movement is made such as waving as if striking a percussion instrument like a drum, a sensor detects this music playing movement, and a percussion instrument sound is generated.

According to such a musical instrument, musical notes of this instrument can be generated without requiring a real instrument; therefore, it enables a player to enjoy music playing without being subjected to limitations in the music playing location or music playing space.

As such a musical instrument, an instrument game device is proposed in Japanese Patent No. 3599115, for example, that is configured so as to capture an image of a music playing movement of a player using a stick-shaped member, while displaying a composite image combining a captured image of the music playing movement and a virtual image showing an instrument set on a monitor, and generates a predetermined musical note depending on position information of the stick-shaped member and the virtual instrument set.

However, with the instrument game device described in Japanese Patent No. 3599115, it has not been possible to reflect the three-dimensional arrangement of a drum set, for example, since the virtual instrument set is arranged on an image-capturing plane, i.e. on a virtual two-dimensional plane. For this reason, a player has not been able to obtain a sense of a realistic music playing.

In addition, in a case of trying to change the layout (arrangement) of a virtual instrument set displayed on a display that is two dimensional, as in the instrument game device described in Japanese Patent No. 3599115, a touch panel function is provided to the display, whereby designation of the virtual instrument and changes in the display positions are enabled with relative simplicity by performing a contact operation on this touch panel.

However, in a case of a virtual instrument set being able to be displayed three-dimensionally, and the layout thereof not only being the left-right and up-down directions of the display, but also reflecting the height direction, when changing the layout, the movement in the horizontal direction of the virtual instrument and the height direction come to be performed within the same screen region, whereby operation becomes difficult.

SUMMARY OF THE INVENTION

The present invention has been made taking such a situation into account, and has an object of providing a musical instrument, method and recording medium that enable a player to obtain a sense of realistic music playing by establishing the arrangement of a virtual instrument set in a three-dimensional arrangement.

In order to achieve the above-mentioned object, a musical instrument according to an aspect of the present invention includes:

memory that stores layout information containing a plurality of regions arranged on a predetermined virtual plane and pitch angle ranges corresponding to each of the plurality of regions;

a pitch angle sensor that detects a pitch angle of a music playing member that can be held by a player during a music playing operation;

a position sensor that detects position coordinates of the music playing member on the virtual plane;

a first determination unit that determines whether the position coordinates of the music playing member belong to any of the plurality of regions arranged on the image-capturing plane based on the layout information stored in the memory, at a timing at which a music playing operation is made by way of the music playing member;

a second determination unit that determines, in a case of the first determination unit having determined as belonging to a region, whether the pitch angle of the music playing member detected by way of the pitch angle sensor belongs to a pitch angle range corresponding to the region; and a sound generation instruction unit that instructs generation of a sound of a musical note corresponding to the region, in a case of the second determination unit having determined as belonging to the pitch angle range corresponding to the region.

In addition, in order to achieve the above-mentioned object, according to a music playing method of an aspect of the present invention, in a method for a musical instrument having memory that stores layout information containing a plurality of regions arranged on a predetermined virtual plane and pitch angle ranges corresponding to each of the plurality of regions; a pitch angle sensor that detects a pitch angle of a music playing member that can be held by a player during a music playing operation; and a position sensor that detects position coordinates of the music playing member on the virtual plane, the method includes the steps of:

determining whether the position coordinates of the music playing member belong to any of a plurality of regions arranged on the image-capturing plane based on the layout information stored in the memory, at a timing at which a music playing operation is made by way of the music playing member;

determining, in a case of having determined as belonging to the region, whether the pitch angle of the music playing member detected by way of the pitch angle sensor belongs to a pitch angle range corresponding to the region; and instructing generation of a musical note corresponding to the region, in a case of having determined as belonging to the pitch angle region corresponding to the region.

In addition, in order to achieve the above-mentioned object, according to a recording medium of an aspect of the present invention, in a computer readable recording medium used in a musical instrument having memory that stores layout information containing a plurality of regions arranged on a predetermined virtual plane and pitch angle ranges corresponding to each of the plurality of regions; a pitch angle sensor that detects a pitch angle of a music playing member that can be held by a player during a music playing operation; and a position sensor that detects position coordinates of the music playing member on the virtual plane, the recording medium encoded with a program that enables the computer to execute:

a first determining step of determining whether the position coordinates of the music playing member belong to any of a plurality of regions arranged on an image-capturing plane based on the layout information stored in the memory, at a timing at which a music playing operation is made by way of the music playing member;

a second determining step of determining, in a case of having determined in the first determining step as belonging to the region, whether the pitch angle of the music playing member detected by way of the pitch angle sensor belongs to a pitch angle range corresponding to the region; and a sound-generation instruction step of instructing generation of a musical note corresponding to the region, in a case of having determined in the second determining step as belonging to the pitch angle region corresponding to the region.

DETAILED DESCRIPTION OF THE INVENTION

Hereinafter, embodiments of the present invention will be explained while referencing the drawings.

(Overview of Musical Instrument 1)

First, an overview of a musical instrument 1 as an embodiment of the present invention will be explained while referencing FIGS. 1A and 1B.

Figure 1A:
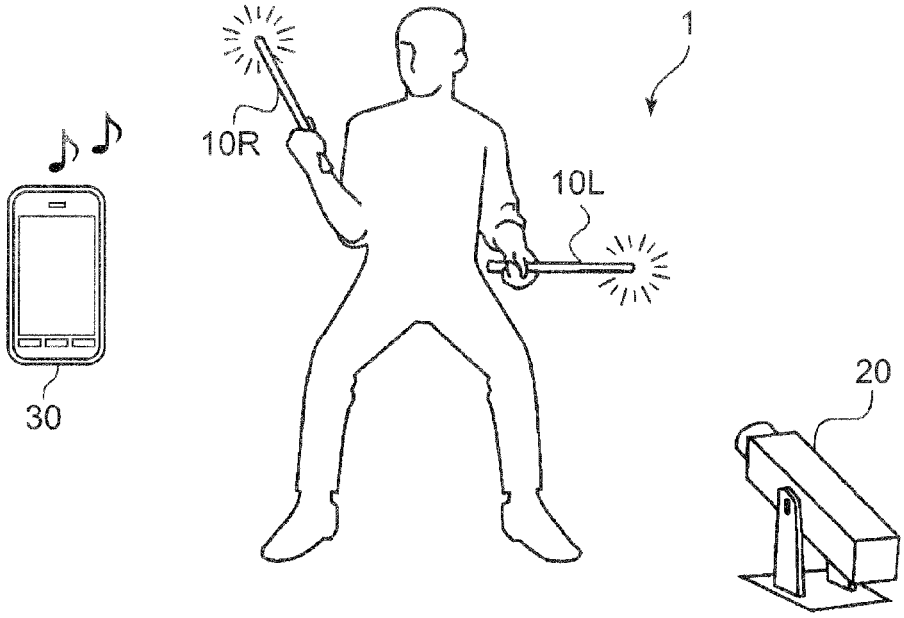
FIGS. 1A and 1B are illustrations showing an outline of an embodiment of a musical instrument according to the present invention.
Figure 1B:
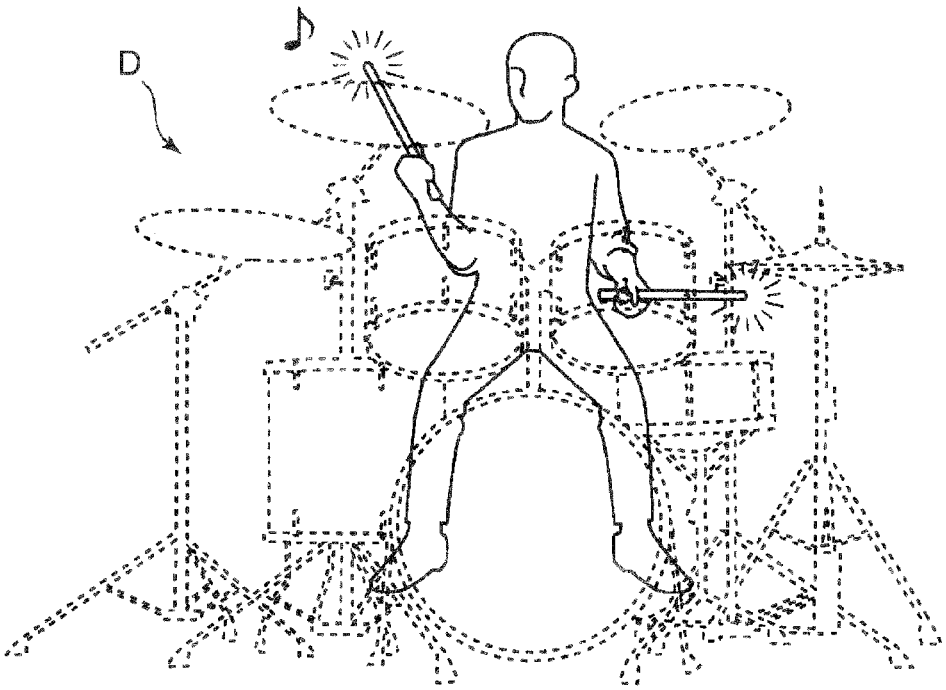

As shown in FIG. 1A, the musical instrument 1 of the present embodiment is configured to include sticks 10R, 10L, a camera unit 20, and a center unit 30. The center unit 30 of the present embodiment is a small portable terminal such as a cellular telephone. Although the musical instrument 1 of the present embodiment is configured to include the two sticks 10R, 10L in order to realize a virtual drum playing using two sticks, the number of sticks is not limited thereto, and may be one, or may be three or more. It should be noted that, in cases in which it is unnecessary to distinguish between the sticks 10L and 10R, they both will be generalized and referred to as "sticks 10" hereinafter.

The sticks 10 are members of stick shape extending in a longitudinal direction. As a music playing movement, a player makes up swing and down swing movements about the wrist, etc. holding one end (base side) of the stick 10 in the hand. Various sensors such as an acceleration sensor and angular velocity sensor are provided in the other end (leading end side) of the stick 10 in order to detect such a music playing movement of the player. Based on the music playing movement detected by these various sensors, the stick 10 sends a Note-on-Event to the center unit 30.

In addition, a marker 15 (refer to FIG. 2) described later is provided to the leading end side of the stick 10, and the camera unit 20 is configured to be able to distinguish the leading end of the stick 10 during image capturing.

The camera unit 20 is configured as an optical imaging device, and captures an image of a space including the player holding the sticks 10 and carrying out music playing movements as a subject (hereinafter referred to as "image capturing space") at a predetermined frame rate, and outputs as data of a dynamic image. The camera unit 20 specifies position coordinates within image capturing space of the marker 15 while emitting light, and sends data indicating these position coordinates (hereinafter referred to as "position coordinate data") to the center unit 30.

Upon receiving a Note-on-Event from the stick 10, the center unit 30 generates a predetermined musical note according to the position coordinate data of the marker 15 during reception. More specifically, the center unit 30 stores position coordinate data of a virtual drum set D shown in FIG. 1B, to be associated with the image capturing space of the camera unit 20, and based on the position coordinate data of this virtual drum set D and the position coordinate data of the marker 15 during Note-on-Event reception, an instrument virtually struck by the stick 10 is specified, and a musical note corresponding to the instrument is generated.

Next, the configuration of such a musical instrument 1 of the present embodiment will be specifically explained.

(Configuration of Musical Instrument 1)

First, the configurations of each constituent element of the musical instrument 1 of the present embodiment, i.e. the sticks 10, camera unit 20 and center unit 30, will be explained while referencing FIGS. 2 to 5.

(Configuration of Sticks 10)

Figure 2:
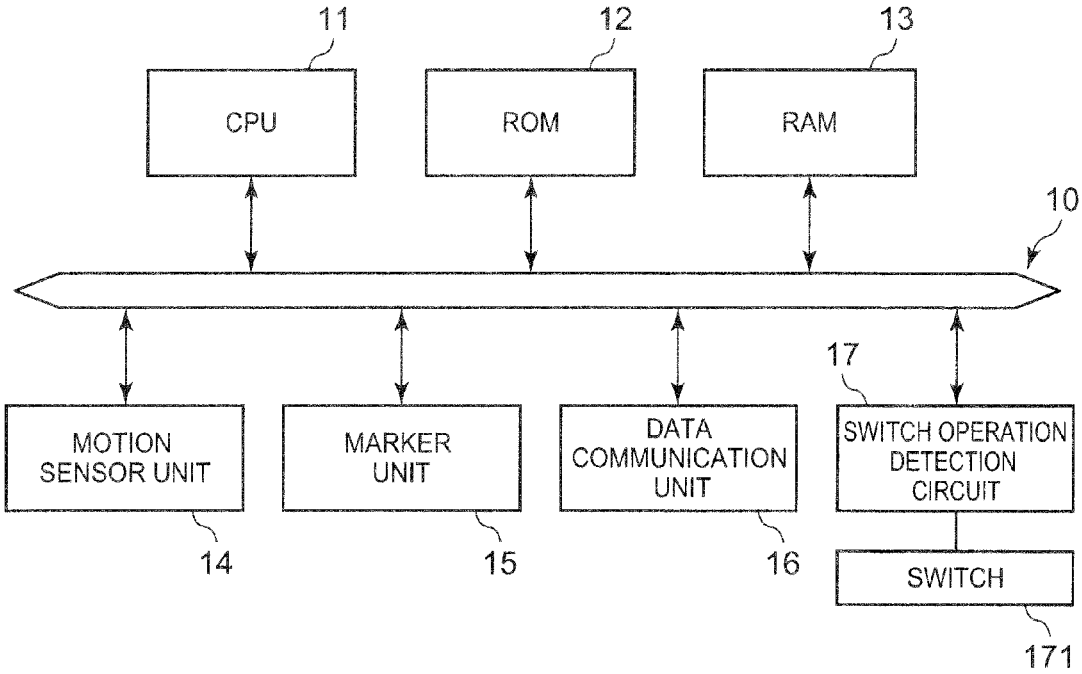
FIG. 2 is a block diagram showing a hardware configuration of a stick configuring the musical instrument.

FIG. 2 is a block diagram showing the hardware configuration of the stick 10.

As shown in FIG. 2, the stick 10 is configured to include a CPU 11 (Central Processing Unit), ROM 12 (Read Only Memory), RAM 13 (Random Access Memory), a motion sensor unit 14, the marker 15, a data communication unit 16, and a switch operation detection circuit 17.

The CPU 11 executes control of the overall stick 10, and in addition to detection of the attitude of the stick 10, shot detection and action detection based on the sensor values outputted from the motion sensor unit 14, for example, also executes control such as light-emission and switch-off of the marker 15. At this time, the CPU 11 reads marker characteristic information from the ROM 12, and executes light-emission control of the marker 15 in accordance with this marker characteristic information. In addition, the CPU 11 executes communication control with the center unit 30 via the data communication unit 16.

The ROM 12 stores processing programs for various processing to be executed by the CPU 11. In addition, the ROM 12 stores the marker characteristic information used in the light-emission control of the marker 15. Herein, the camera unit 20 must distinguish between the marker 15 of the stick 10R (hereinafter referred to as "first marker" as appropriate) and the marker 15 of the stick 10L (hereinafter referred to as "second marker" as appropriate). Marker characteristic information is information for the camera unit 20 to distinguish between the first marker and the second marker, and in addition to the shape, size, color, chroma, or brightness during light emission, for example, it is possible to use the blinking speed or the like during light emission.

The CPU 11 of the stick 10R and the CPU 11 of the stick 10L read respectively different marker characteristic information, and execute light-emission control of the respective markers.

The RAM 13 stores the values acquired or generated in processing such as various sensor values outputted by the motion sensor unit 14.

The motion sensor unit 14 is various sensors for detecting the state of the stick 10, and outputs predetermined sensor values. Herein, an acceleration sensor, angular velocity sensor, magnetic sensor, or the like can be used as the sensors configuring the motion sensor unit 14, for example.

Figure 3:
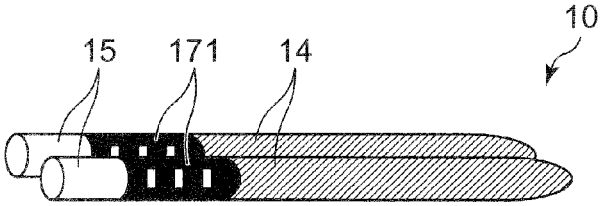
FIG. 3 is a perspective view of the stick.

FIG. 3 is a perspective view of the stick 10, in which a switch part 171 and the marker 15 are arranged on the outside.

The player holds one end (base side) of the stick 10, and carries out a swing up and swing down movement about the wrist or the like, thereby giving rise to motion of the stick 10. On this occasion, sensor values according to this motion come to be outputted from the motion sensor unit 14.

The CPU 11 having received the sensor values from the motion sensor unit 14 detects the state of the stick 10 being held by the player. As one example, the CPU 11 detects the striking timing of a virtual instrument by the stick 10 (hereinafter referred to as "shot timing"). The shot timing is the timing immediately prior to the stick 10 being stopped after being swung downward, and is the timing at which the magnitude of the acceleration in an opposite direction to the down swing direction acting on the stick 10 exceeds a certain threshold.

Furthermore, the sensor values of the motion sensor unit 14 also include data required in order to detect the "pitch angle", which is the angle formed between a longitudinal direction and horizontal plane when a player holds the stick 10, and "yaw angle", which is the angle formed between this longitudinal direction and a surface orthogonal to the horizontal plane.

Referring back to FIG. 2, the marker 15 is a luminous body provided on a leading end side of the stick 10, is configured with an LED or the like, for example, and emits light and switches off depending on the control of the CPU 11. More specifically, the marker 15 emits light based on the marker characteristic information read by the CPU 11 from the ROM 12. At this time, since the marker characteristic information of the stick 10R and the marker characteristic information of the stick 10L differ, the camera unit 20 can distinctly acquire the position coordinates of the marker of the stick 10R (first marker) and the position coordinates of the marker of the stick 10L (second marker) separately.

The data communication unit 16 performs predetermined wireless communication with at least the center unit 30. The predetermined wireless communication may be configured to be performed by any method, and in the present embodiment, wireless communication with the center unit 30 is performed by way of infrared communication. It should be noted that the data communication unit 16 may be configured to perform wireless communication with the camera unit 20, and may be configured to perform wireless communication with the stick 10R and the stick 10L.

The switch operation detection circuit 17 is connected with a switch 171, and receives input information through this switch 171.

(Configuration of Camera Unit 20)

The explanation for the configuration of the stick 10 is as given above. Next, the configuration of the camera unit 20 will be explained while referencing FIG. 4.

Figure 4:
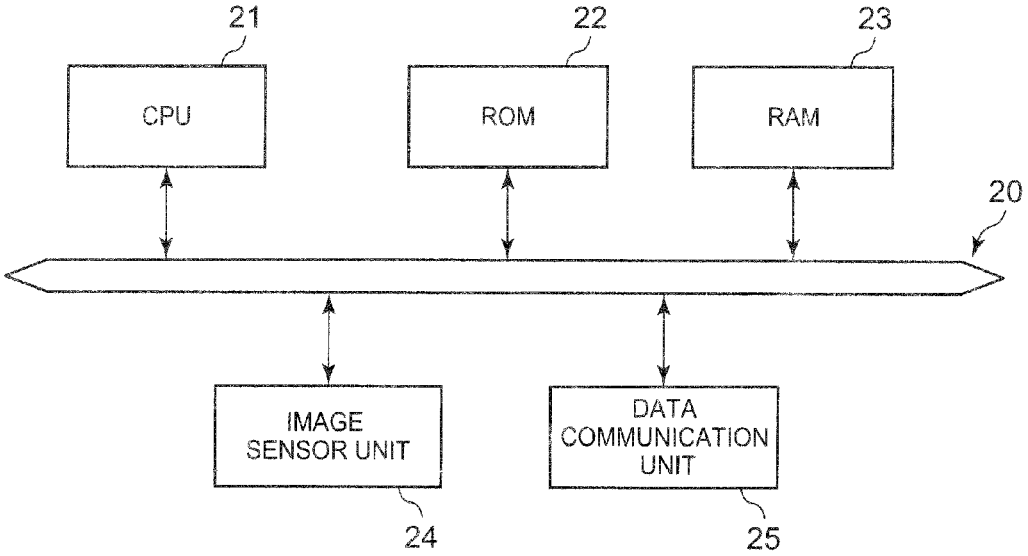
FIG. 4 is a block diagram showing a hardware configuration of a camera unit configuring the musical instrument.

FIG. 4 is a block diagram showing the hardware configuration of the camera unit 20.

The camera unit 20 is configured to include a CPU 21, ROM 22, RAM 23, an image sensor unit 24, and data communication unit 25.

The CPU 21 executes control of the overall camera unit 20 and, for example, based on the position coordinate data of the marker 15 detected by the image sensor unit 24 and marker characteristic information, executes control to calculate the position coordinate data of each of the markers 15 (first marker and second marker) of the sticks 10R and 10L, and output the position coordinate data indicating the calculation result of each. In addition, the CPU 21 executes communication control to transmit the calculated position coordinate data and the like to the center unit 30 via the data communication unit 25.

The ROM 22 stores processing programs for various processing executed by the CPU 21. The RAM 23 stores values acquired or generated in the processing such as position coordinate data of the marker 15 detected by the image sensor unit 24. In addition, the RAM 23 jointly stores the marker characteristic information of each of the sticks 10R and 10L received from the center unit 30.

The image sensor unit 24 is an optical camera, for example, and captures images of the player carrying out music playing movements while holding the sticks 10 at a predetermined frame rate. In addition, the image sensor unit 24 outputs image capture data of each frame to the CPU 21. It should be noted that, specifying of the position coordinates of the marker 15 of the stick 10 within a captured image may be performed by the image sensor unit 24, or may be performed by the CPU 21. Similarly, the marker characteristic information of the captured marker 15 also may be specified by the image sensor unit 24, or may be specified by the CPU 21.

The data communication unit 25 performs predetermined wireless communication (e.g., infrared communication) with at least the center unit 30. It should be noted that the data communication unit 25 may be configured to perform wireless communication with the sticks 10.

(Configuration of Center Unit 30)

The explanation for the configuration of the camera unit 20 is as given above. Next, the configuration of the center unit 30 will be explained while referencing FIG. 5.

Figure 5:
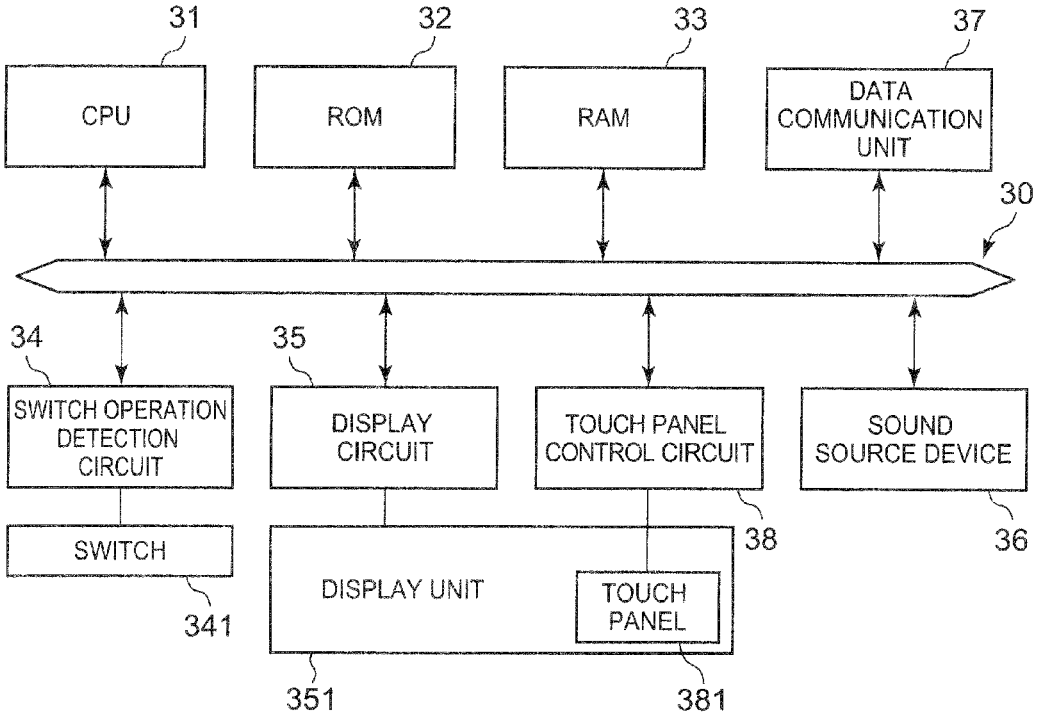
FIG. 5 is a block diagram showing a hardware configuration of a center unit configuring the musical instrument.

FIG. 5 is a block diagram showing the hardware configuration of the center unit 30.

The center unit 30 is configured to include a CPU 31, ROM 32, RAM 33, a switch operation detection circuit 34, a display circuit 35, a sound generating device 36, a data communication unit 37, and a touch panel control circuit 38.

The CPU 31 executes control of the overall center unit 30 and, for example, based on the shot detection received from the stick 10 and the position coordinates of the marker 15 received from the camera unit 20, executes control such as to generate predetermined musical notes. In addition, the CPU 31 executes communication control with the sticks 10 and the camera unit 20 via the data communication unit 37.

The ROM 32 stores processing programs of various processing executed by the CPU 31. In addition, to be associated with the position coordinates and the like, the ROM 32 stores the waveform data (tone data) of wind instruments such as the flute, saxophone and trumpet, keyboard instruments such as the piano, stringed instruments such as the guitar, and percussion instruments such as the bass drum, hi-hat, snare, cymbal and tam tam.

Figure 6:
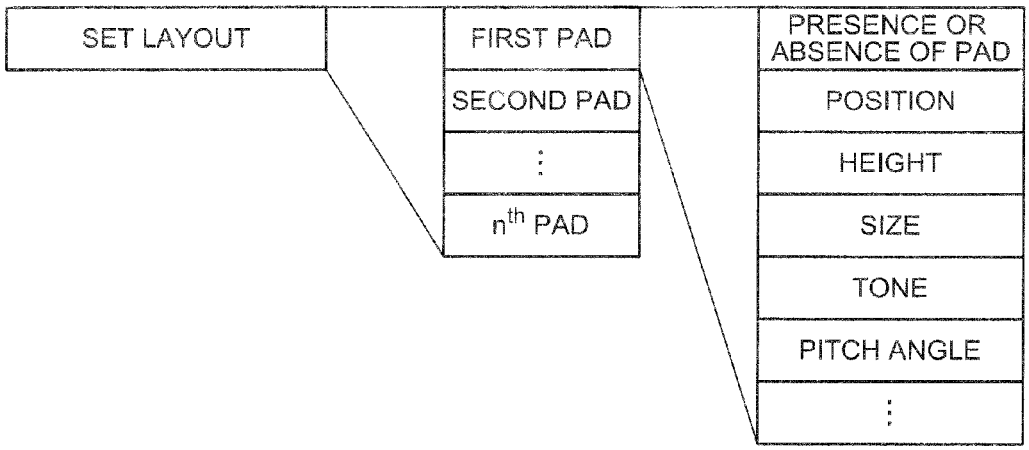
FIG. 6 is a diagram showing set layout information according to an embodiment of the musical instrument according to the present invention.

As the storage method of tone data and the like, for example, the set layout information includes n number of pad information from a first pad until an $n^{th}$ pad, and further, the presence of a pad (presence of a virtual pad existing on a virtual plane described later), position (position coordinates on virtual plane described later), height (distance vertically upwards from virtual plane described later), size (shape, diameter, etc. of virtual pad), tone (waveform data), etc. are stored to be associated in respective pad information, as shown as set layout information in FIG. 6.

It should be noted that, in the present embodiment, in a case of trying with the stick 10 to make a shot of a virtual pad arranged virtually over a distance in a vertically upward direction from the virtual plane, the aforementioned height corresponds to the pitch angle range of the stick 10 enabling this shot.

Figure 7:
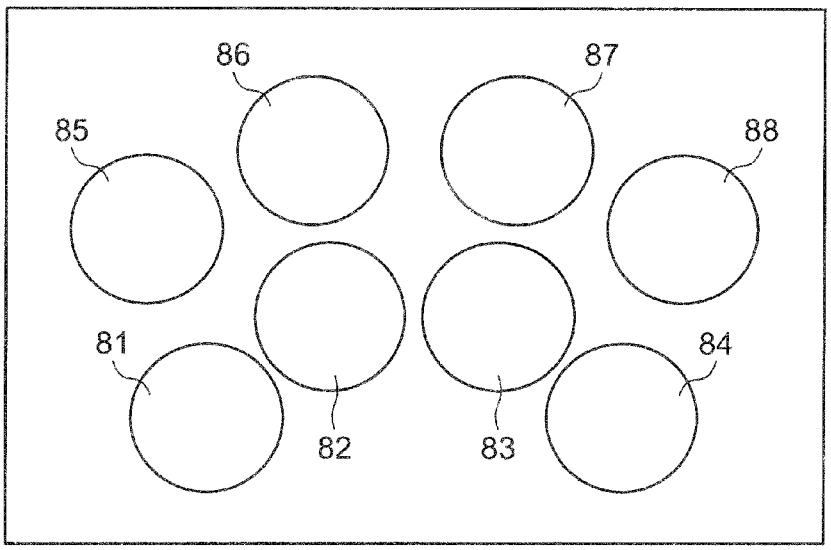
FIG. 7 is an illustration visualizing the concept indicated by the set layout information on a virtual plane.

Herein, the specific set layout will be explained while referencing FIG. 7. FIG. 7 is an illustration visualizing the concept indicated by the set layout information (refer to FIG. 6) stored in the ROM 32 of the center unit 30 on a virtual plane.

FIG. 7 shows an aspect of the eight virtual pads 81 to 88 being arranged on a virtual plane, and among the first pad to $n^{th}$ pad, pads for which the pad presence data is "pad present" correspond to virtual pads 81 to 88. For example, the eight of the second pad, third pad, fifth pad, sixth pad, eighth pad, ninth pad, twelfth pad and thirteenth pad are corresponding. Furthermore, the virtual pads 81 to 88 are arranged based on position data, size data and height data. Furthermore, tone data is also associated with each virtual pad. Therefore, in a case of the position coordinates of the marker 15 during shot detection belonging to a region corresponding to the virtual pad 81 to 88, and the pitch angle of the stick 10 during shot detection belonging to a range of pitch angles established for each of the virtual pads 81 to 88, a tone corresponding to the virtual pad 81 to 88 is generated.

It should be noted that the CPU 31 displays this virtual plane on a display device 351 described later, along with the arrangement of the virtual pads 81 to 88.

In addition, in the present embodiment, the position coordinates on this virtual plane are established so as to match the position coordinates in the captured image of the camera unit 20.

Referring back to FIG. 5, the RAM 33 stores values acquired or generated in processing such as the state of the stick 10 received from the stick 10 (shot detection, etc.), the position coordinates of the marker 15 received from the camera unit 20, and set layout information read from the ROM 32.

By the CPU 31 reading tone data (waveform data) corresponding to the virtual pad 81 of the region to which the position coordinates of the marker 15 belong upon shot detection (i.e. upon Note-on-Event reception) from the set layout information stored in the RAM 33, a musical note in accordance with the music playing movement of the player is generated.

The switch operation detection circuit 34 is connected with a switch 341, and receives input information through this switch 341. The input information includes a change in the volume of a musical note generated or tone of a musical note generated, a setting and change in the set layout number, a switch in the display of the display device 351, and the like, for example.

In addition, the display circuit 35 is connected with a display device 351, and executes display control of the display device 351. It should be noted that the display device 351 includes a touch panel 381 described later.

In accordance with an instruction from the CPU 31, the sound generating device 36 reads waveform data from the ROM 32, generates musical note data and converts the musical note data into an analog signal, and then generates musical notes from a speaker, which is not illustrated.

In addition, the data communication unit 37 performs predetermined wireless communication (e.g., infrared communication) with the sticks 10 and the camera unit 20.

The touch panel control circuit 38 is connected with a touch panel 381, detects a contact operation on the touch panel 381, and outputs a detection signal. In response to this contact operation, the CPU 31 adjusts the position, size and height of a virtual pad. It should be noted that, if the touch panel 381 has detected a contact operation, it outputs a signal indicating the fact of having detected to the touch panel control circuit 38.

(Processing of Musical Instrument 1)

The configurations of the sticks 10, camera unit 20 and center unit 30 configuring the musical instrument 1 have been explained in the foregoing. Next, processing of the musical instrument 1 will be explained while referencing FIGS. 8 to 11B.

(Processing of Sticks 10)

Figure 8:
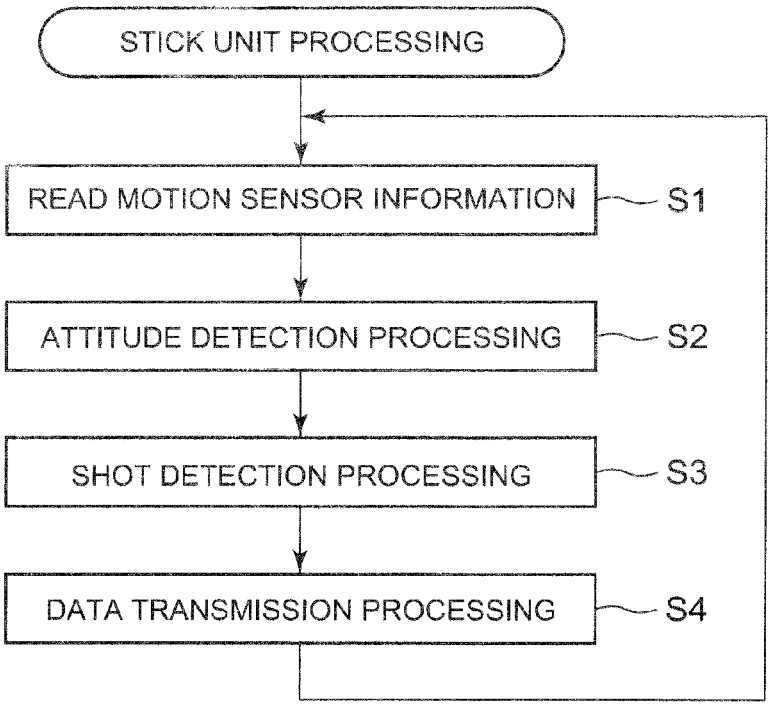
FIG. 8 is a flowchart showing the flow of processing of the stick.

FIG. 8 is a flowchart showing the flow of processing executed by the stick 10 (hereinafter referred to as "stick processing").

Referring to FIG. 8, the CPU 11 of the stick 10 reads motion sensor information from the motion sensor unit 14, i.e. sensor values outputted by various sensors, and stores the information in the RAM 13 (Step S1). Subsequently, the CPU 11 executes attitude sensing processing of the stick 10 based on the motion sensor information thus read (Step S2). In the attitude sensing processing, the CPU 11 detects the attitude of the stick 10, e.g., roll angle and pitch angle of the stick 10, based on the motion sensor information.

Next, the CPU 11 executes shot detection processing based on the motion sensor information (Step S3). Herein, in a case of a player carrying out music playing using the sticks 10, generally, similar music playing movements as the movements to strike an actual instrument (e.g., drums) are performed. With such music playing movements, the player first swings up the stick 10, and then swings down towards a virtual instrument. Then, just before striking the stick 10 against the virtual instrument, the player applies a force trying to stop the movement of the stick 10. At this time, the player assumes that a musical note will generate at the moment striking the stick 10 against the virtual instrument; therefore, it is desirable to be able to generate a musical note at the timing assumed by the player. Therefore, in the present embodiment, it is configured so as to generate a musical note at the timing of a moment the player strikes the stick 10 against the surface of a virtual instrument, or a short time before then.

In the present embodiment, the timing of shot detection is the timing immediately prior to the stick 10 being stopped after being swung downward, and is the timing at which the magnitude of the acceleration in an opposite direction to the down swing direction acting on the stick 10 exceeds a certain threshold.

With this timing of shot detection as the sound generation timing, when it is determined that the sound generation timing has arrived, the CPU 11 of the stick 10 generates a Note-on-Event, and sends the Note-on-Event to the center unit 30. The sound generation processing is thereby executed in the center unit 30 and a musical note is generated.

In the shot detection processing indicated in Step S3, a Note-on-Event is generated based on motion sensor information (e.g., a sensor composite value of the acceleration sensor). At this time, it may be configured so as to include the volume of the generating musical note in the generated Note-on-Event. It should be noted that the volume of a musical note can be obtained from the maximum value of a sensor composite value, for example.

Next, the CPU 11 transmits information detected in the processing of Steps S1 to S3, i.e. motion sensor information, attitude information and shot information, to the center unit 30 via the data communication unit 16 (Step S4). At this time, the CPU 11 transmits the motion sensor information, attitude information and shot information to the center unit 30 to be associated with the stick identifying information.

The processing is thereby returned to Step S1, and this and following processing is repeated.

(Processing of Camera Unit 20)

Figure 9:
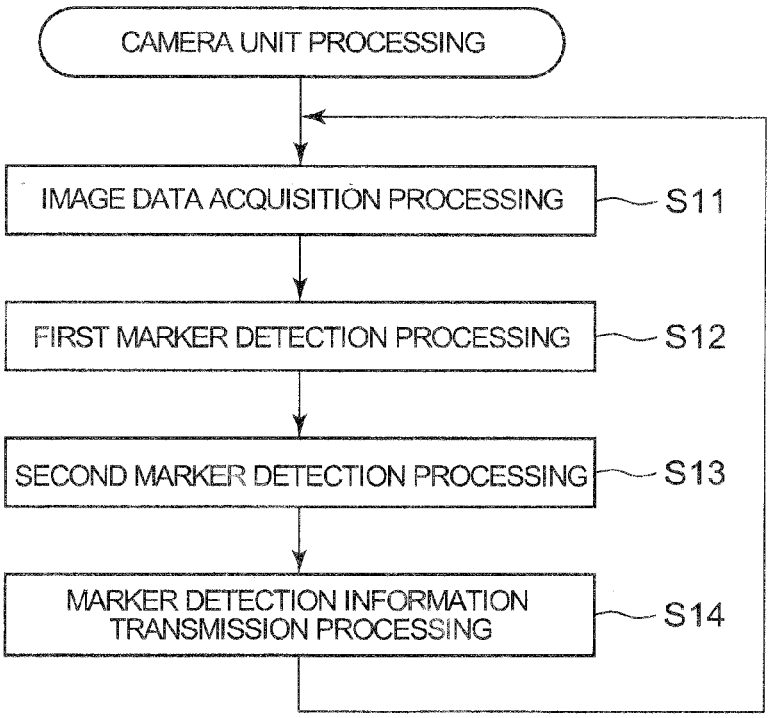
FIG. 9 is a flowchart showing the flow of processing of the camera unit.

FIG. 9 is a flowchart showing the flow of processing executed by the camera unit 20 (hereinafter referred to as "camera unit processing").

Referring to FIG. 9, the CPU 21 of the camera unit 20 executes image data acquisition processing (Step S11). In this processing, the CPU 21 acquires image data from the image sensor unit 24.

Next, the CPU 21 executes first marker detection processing (Step S12) and second marker detection processing (Step S13). In the respective processing, the CPU 21 acquires, and stores in the RAM 23, marker detection information such as of the position coordinates, size and angle of the marker 15 (first marker) of the stick 10R and the marker 15 (second marker) of the stick 10L, detected by the image sensor unit 24. At this time, the image sensor unit 24 detects marker detection information for the markers 15 emitting light.

Next, the CPU 21 transmits the marker detection information acquired in Step S12 and Step S13 to the center unit 30 via the data communication unit 25 (Step S14), and then advances the processing to Step S11.

(Processing of Center Unit 30)

Figure 10:
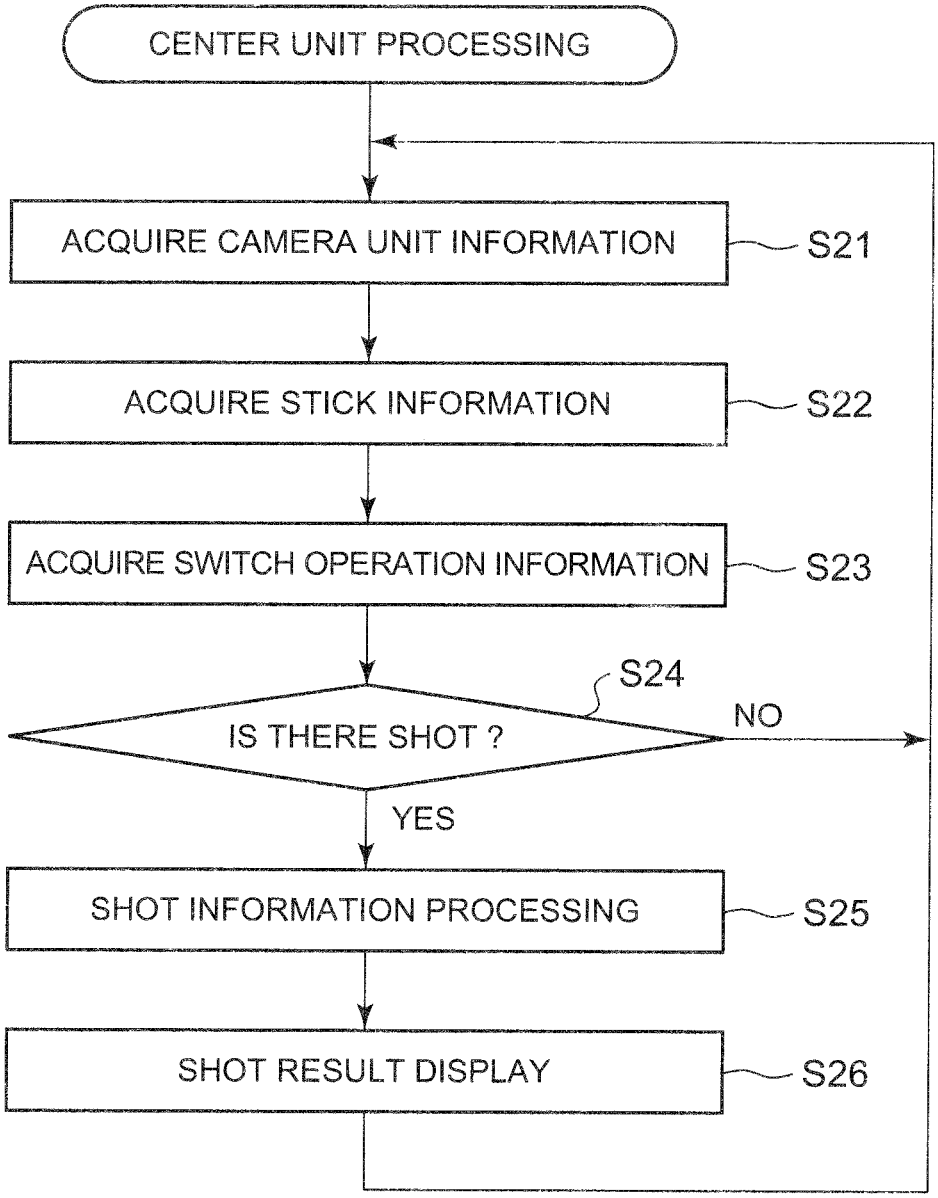
FIG. 10 is a flowchart showing the flow of processing of the center unit.

FIG. 10 is a flowchart showing the flow of processing executed by the center unit 30 (hereinafter referred to as "center unit processing").

Referring to FIG. 10, the CPU 31 of the center unit 30 receives the respective marker detection information of the first marker and the second marker from the camera unit 20, and stores the information in the RAM 33 (Step S21). In addition, the CPU 31 receives motion sensor information, attitude information and shot information associated with stick identifying information from each of the sticks 10R and 10L, and stores the information in the RAM 33 (Step S22). Furthermore, the CPU 31 acquires information inputted by way of the operation of the switches 341 (Step S23).

Next, the CPU 31 determines whether or not there is a shot (Step S24). In this processing, the CPU 31 determines the presence of a shot according to whether or not a Note-on-Event has been received from the sticks 10. At this time, in a case of having determined there is a shot, the CPU 31 executes shot information processing (Step S25).

In a case of having determined there is not a shot, the CPU 31 causes the processing to advance to Step S21. In the shot information processing, the CPU 31 determines whether the position coordinates included in the marker detection information belong to any of the virtual pads 81 to 88, based on the set layout information read into the RAM 33. In the case of having determined as belonging, it is determined whether the pitch angle included in the attitude information stored in the RAM 33 belongs to the range of pitch angles corresponding to the virtual pad to which it was determined as belonging to. In a case of having determined as belonging also in this determination, tone data (waveform data) corresponding to a virtual pad determined as belonging in a previous determination is read, and outputted to the sound generating device 36 along with the volume data included in the Note-on-Event. Then, the sound generating device 36 generates a corresponding musical note based on the accepted waveform data.

Next, the CPU 31 displays the shot results at the shot timing (Step S26). The display of shot results is described later while referencing FIGS. 11A, 11B and 12. When the processing of Step S26 ends, the CPU 31 ends the center unit processing.

(Display Example of Shot Results)

Figure 11A:
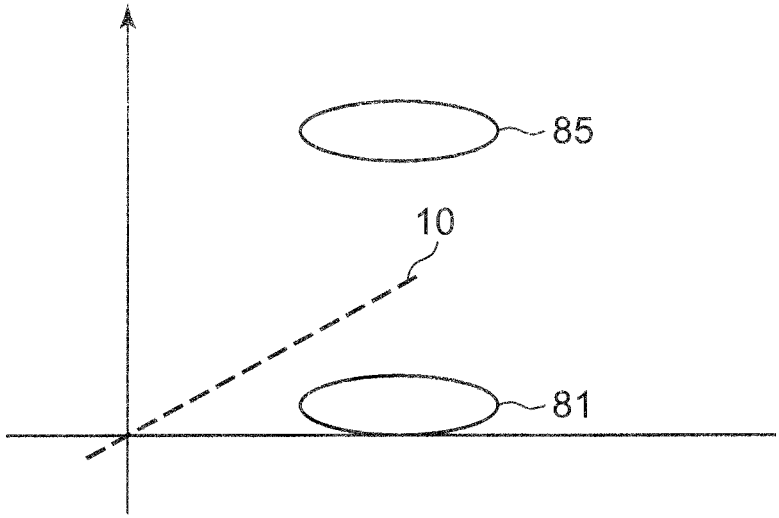
FIGS. 11A and 11B are graphs showing display examples of shot results based on pitch angle.
Figure 11B:
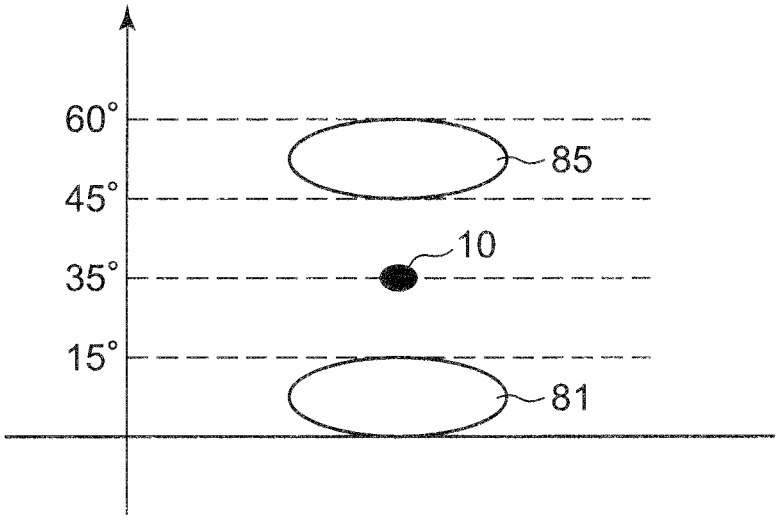

FIGS. 11A and 11B are graphs showing display examples of shot results based on pitch angle, and a display example is shown for a case of not having generated sound at a tone corresponding to the virtual pad 81 or virtual pad 85, despite the player trying to make a shot of the virtual pad 81 or virtual pad 85. In FIG. 11A, the pitch angle of the stick 10 at the shot timing is illustrated by displaying the attitude of the stick 10 itself. In FIG. 11B, the pitch angle of the stick 10 at the shot timing is illustrated with a specific numerical value, despite there being several.

The player makes a shot of the virtual pad 81 or virtual pad 85 by viewing these displays; therefore, it is possible to learn at how much of a pitch angle a shot should be made, etc. For example, it is possible to learn that, in order to make a shot of the virtual pad 81, the pitch angle is set to the range of 0° to 15°, in order to make a shot of the virtual pad 85, the pitch angle is set to the range of 45° to 60°, the present pitch angle is 30°, etc.

Figure 12:
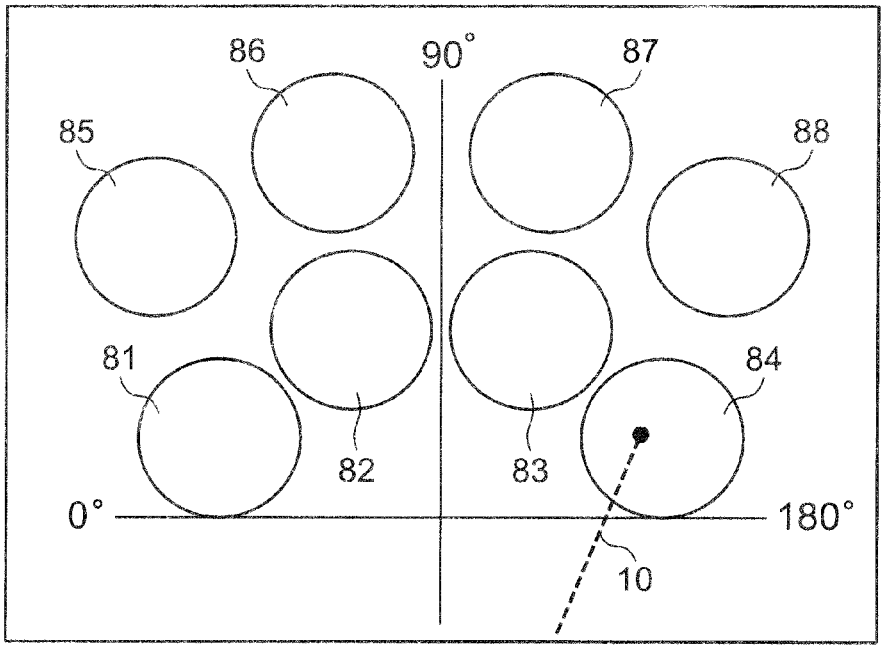
FIG. 12 is a view showing a display example of shot results based on yaw angle.

FIG. 12 is a view showing a display example of shot results based on yaw angle. According to FIG. 12, it is shown that the stick 10 makes a shot of the virtual pad 84 at the shot timing, and further, the angle of a surface of the stick 10 orthogonal to the horizontal plane is shown by displaying the attitude of the stick 10 itself as the yaw angle of the attitude information stored in the RAM 33. The player can learn how much the yaw angle should be adjusted in order to make a shot of the virtual pad 83, for example, by viewing this display.

(Adjustment of Position, Size and Height of Set Layout Information)

In the explanations of FIGS. 13 to 17, the CPU 31 displays images of the virtual pads 81 to 88, etc. on the display device 351 through the display circuit 35, based on the contact operation to the aforementioned touch panel 381.

Figure 13:
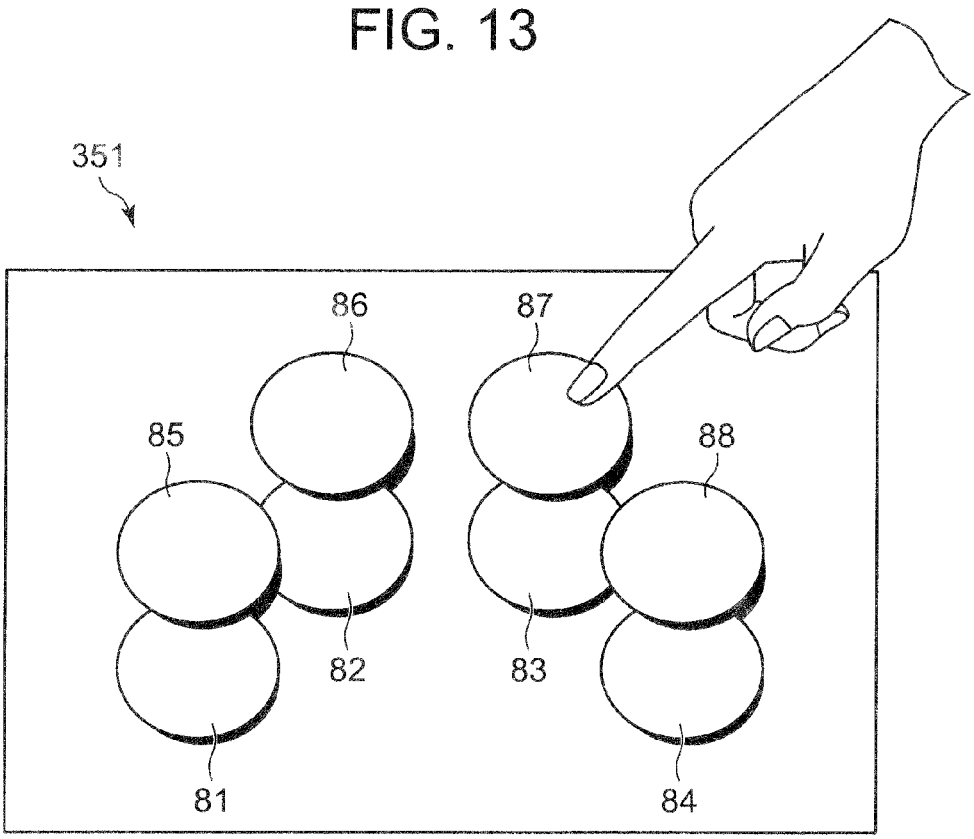
FIG. 13 is a view showing a screen for adjusting set layout information.

FIG. 13 is a view showing an aspect of the arrangement of the virtual pads 81 to 88 displayed on the display device 351, based on the position, size and height of the set layout information. The player can adjust the left-right direction and height direction by touching and dragging the display region of each virtual pad by finger. It is thereby possible to perform adjustment of the left-right direction and height direction of each virtual pad intuitively with easy understanding.

However, in this method, since the left-right direction and height direction are adjusted in one image region of the display device 351, the touch operation becomes complicated, and mistakes due to incorrect operation tend to occur. Therefore, the method of performing a change in the set layout information by dividing an image region of the display device 351 into two regions will be explained while referencing FIGS. 14 to 17.

Figure 14:
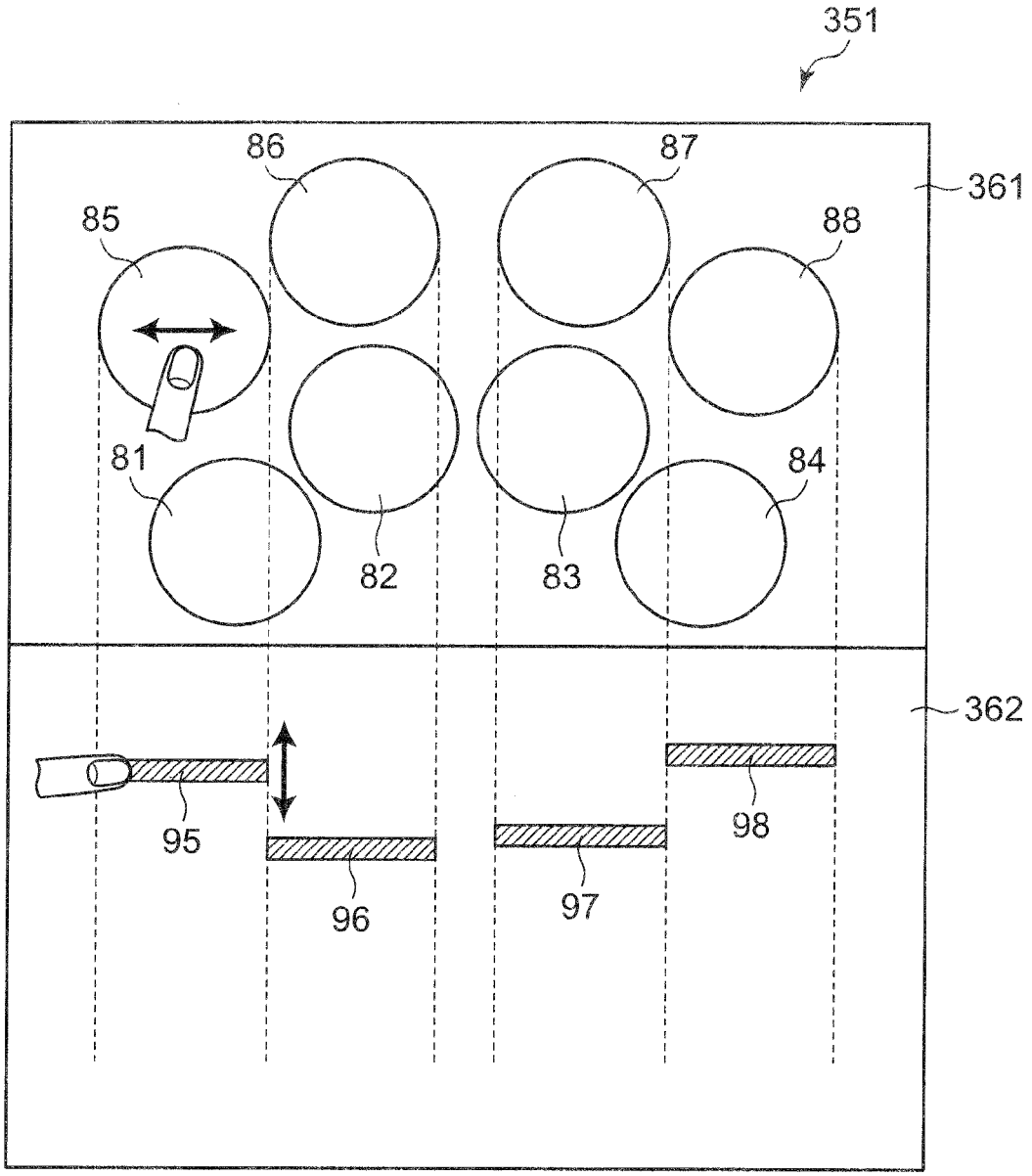
FIG. 14 is a view showing a screen for adjusting set layout information.

FIG. 14 is a view showing an aspect of the arrangement of each of the virtual pads 81 to 88 displayed on the display device 351 based on the positions, sizes and heights of the set layout information. The display regions of the display device 351 are divided into an arrangement display region 361 and a height display region 362. The arrangement of each of the virtual pads 81 to 88 is displayed in the arrangement display region 361 based on the positions and sizes of the set layout information, and the height adjustment icons 95 to 98 corresponding to each of the virtual pads 85 to 88 are displayed in the height display region 362.

For example, when explaining the virtual pad 85 as an example, the player can perform adjustment to cause the position of the virtual pad 85 to move in the left-right direction by touching the region of the virtual pad 85 and dragging in the left-right direction, and can adjust the height of the virtual pad 85 by touching the height adjustment icon corresponding to the virtual pad 85 and dragging in the height direction. It should be noted that the following explanations for other virtual pads are included and the same.

Figure 15:
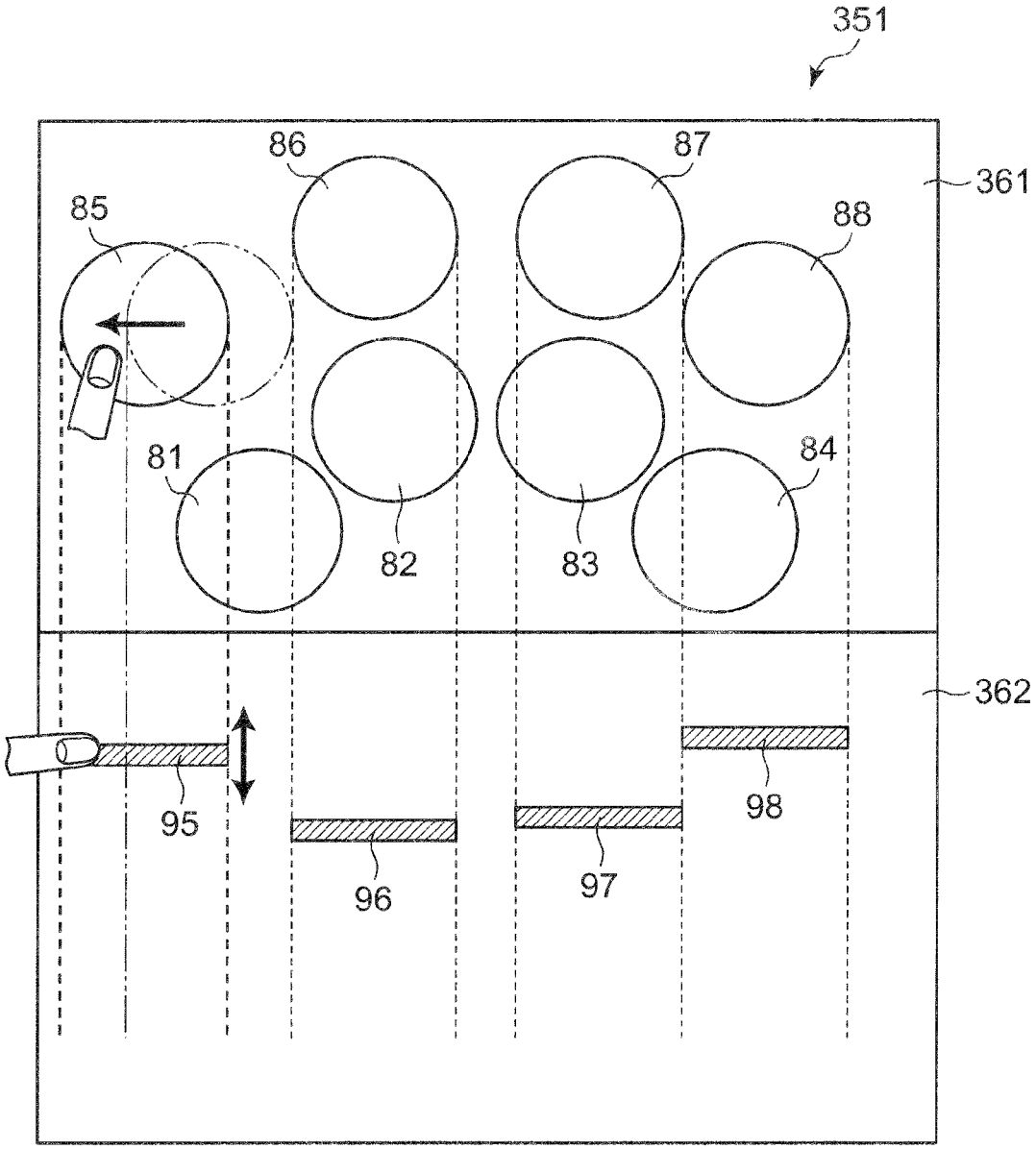
FIG. 15 is a view showing a screen for adjusting set layout information.

In addition, as shown in FIG. 15, in a case of the position of the virtual pad 85 moving by touching the region of the virtual pad 85 and dragging in the left direction, the position of the height adjustment icon 95 also moves so as to follow this.

Figure 16:
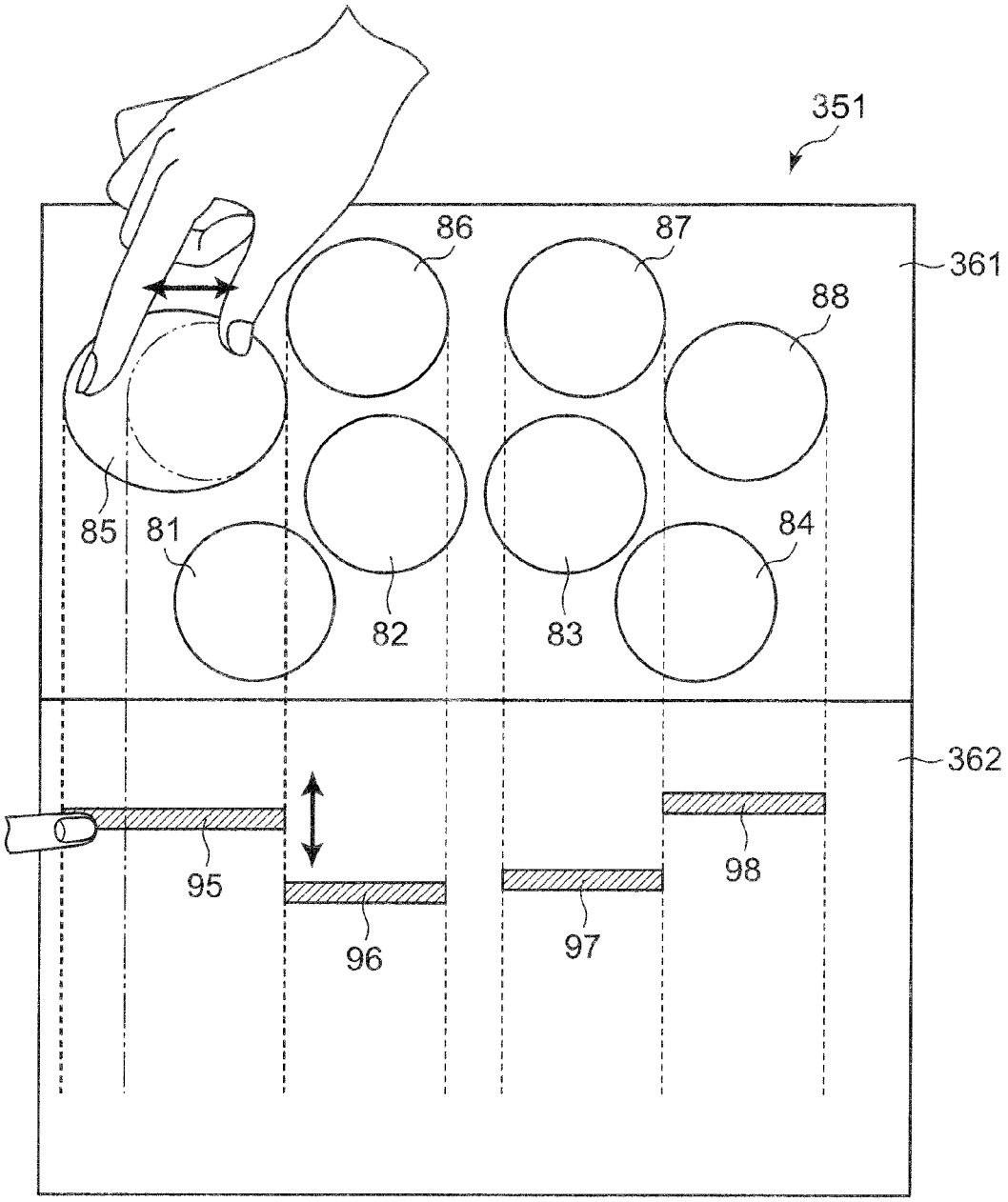
FIG. 16 is a view showing a screen for adjusting set layout information.

Furthermore, as shown in FIG. 16, in a case of touching the region of the virtual pad 85 with two fingers and causing the two fingers to move in directions apart from each other, whereby the size of the virtual pad 85 enlarges, the width of the height adjustment icon 95 also enlarges so as to follow this. In addition, although not illustrated, when two fingers are made to move in directions approaching each other, the size of the virtual pad 85 decreases, and the width of the height adjustment icon 95 also decreases so as to follow this.

Figure 17:
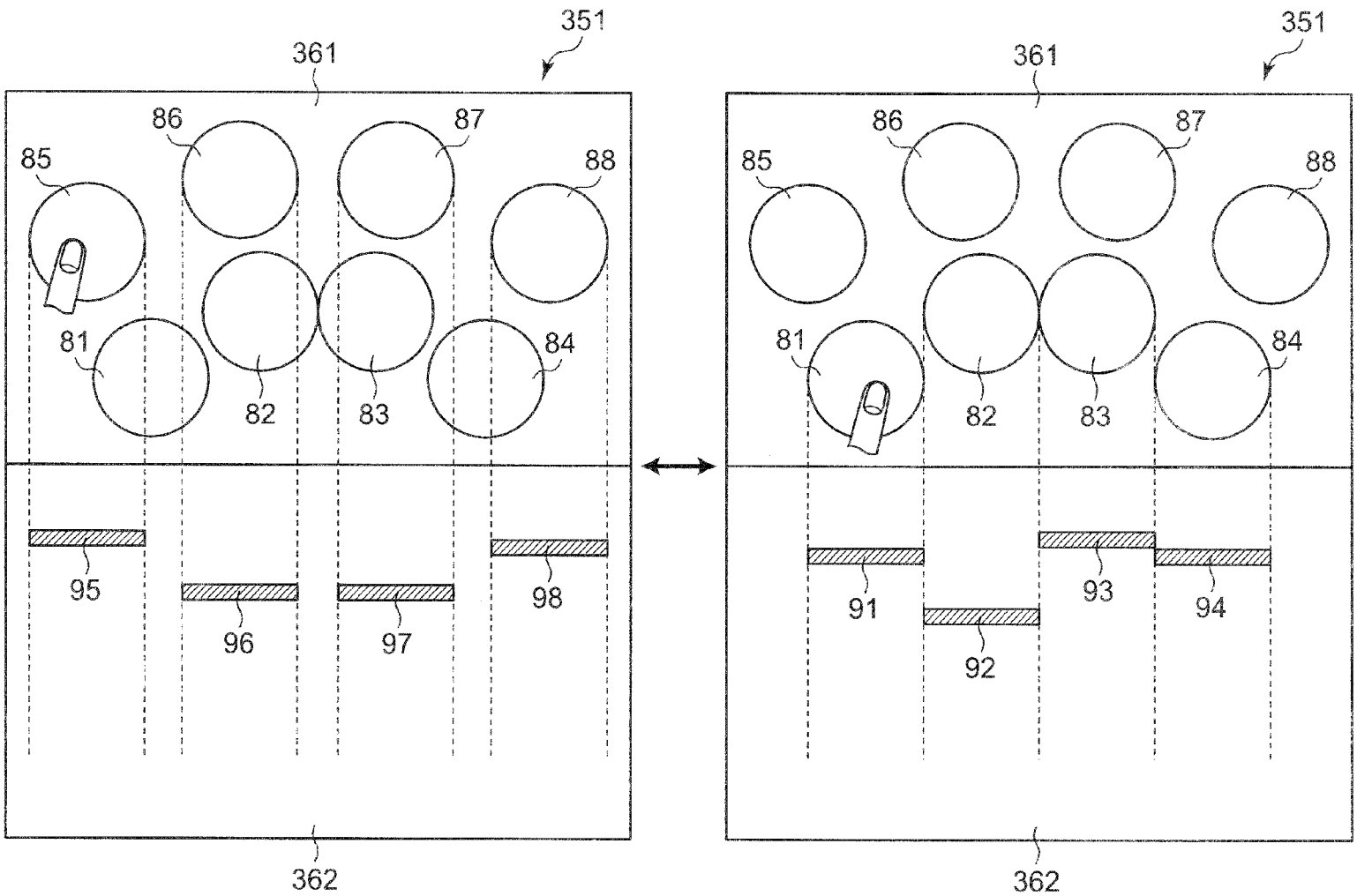
FIG. 17 is a view showing a screen for adjusting set layout information.

Furthermore, as shown in FIG. 17, the virtual pads 81 to 88 are divided into the two groups of the virtual pads 81 to 84 and the virtual pads 85 to 88, and by any of the virtual pads 81 to 84 being touched, the height adjustment icons 91 to 94 corresponding to each of the virtual pads 81 to 84 are displayed, whereby the heights of the virtual pads 81 to 84 can be adjusted. Subsequently, the height adjustment icons 95 to 98 are displayed by any of the virtual pads 85 to 88 being touched, whereby the heights of the virtual pads 85 to 88 can be re-adjusted. In this way, it is possible to switch between the display of height adjustment icons for every group of virtual pads. It should be noted that the number of groups of virtual pads may be 3 or more.

The configuration and processing of the musical instrument 1 of the present embodiment has been explained in the foregoing.

In the present embodiment, the CPU 31 determines whether the position coordinates of the stick 10 belong to any of the virtual pads 81 to 88 arranged based on the set layout information, at the shot timing according to the stick 10, and in a case of having determined as belonging, determines whether the pitch angle of the stick 10 belongs to a predetermined range according to the height corresponding to this virtual pad, and in a case of having determined as belonging to this predetermined range, instructs the generation of a musical note of the tone corresponding to this virtual pad.

Therefore, the player can obtain the sense of a realistic musical performance by having information such as pitch angle correspond to each of the virtual pads of the set layout information.

In addition, in the present embodiment, the CPU 31 notifies the pitch angle of the stick 10 at the shot timing according to the stick 10.

Therefore, the player can confirm the pitch angle at the shot timing.

Furthermore, in the present embodiment, the CPU 31 notifies the pitch angle of the stick 10 in a case of not having determined that the pitch angle of the stick 10 belongs to a predetermined range corresponding to each of the virtual pads 81 to 88, at the shot timing according to the stick 10.

Therefore, the player can learn how to correct the pitch angle by confirming the pitch angle at the shot timing, so as to be able to accurately make a shot of an intended virtual pad.

In addition, the present embodiment provides the arrangement display region 361 displaying the arrangement of regions of each of the virtual pads 81 to 88, the height display region 362 displaying the height of each of the virtual pads 81 to 88, the display device 351 that displays these in different regions on the same screen, and the touch panel 381 that detects a contact operation on the display device 351 and outputs a signal indicating the detection thereof. The CPU 31 adjusts the arrangement of the region of any one of the virtual pads 81 to 88 in a case of having received from the touch panel 381 a signal indicating that a contact operation on the arrangement display region 361 was detected, based on the contact position on the arrangement display region 361 and the arrangement of each of the virtual pads 81 to 88 displayed on the arrangement display region 361, and adjusts the height of any one of the virtual pads 81 to 88 in a case of having received from the touch panel 381 a signal indicating that a contact operation on the height display region 362 was detected, based on the contact position on the height display region 362 and the height adjustment icons 91 to 98 displayed in the height display region 362.

Therefore, upon changing the layout information having three-dimensional information such as the height and pitch angle, it is possible to easily perform a change operation of the layout information by performing a movement in the left-right direction and adjustment in the height direction of the virtual pad in different regions on the screen.

Furthermore, in the present embodiment, the height adjustment icons 91 to 98 displayed in the height display region 362 are displayed to correspond to the arrangement of regions for each of the virtual pads 81 to 88 displayed in the arrangement display region 361.

Therefore, the player can easily grasp which height adjustment icon should be touched to adjust the height of a virtual pad.

In addition, in the present embodiment, in a case of the arrangement of the regions of each of the virtual pads 81 to 88 displayed in the arrangement display region 361 being adjusted, the height adjustment icons 91 to 98 displayed in the height display region 362 are displayed to follow this adjusted arrangement.

Therefore, even in a case of the arrangement of virtual pads being adjusted, the player can easily grasp which height adjustment icon should be touched to adjust the height of a virtual pad.

Although embodiments of the present invention have been explained above, the embodiments are merely exemplifications, and are not to limit the technical scope of the present invention. The present invention can adopt various other embodiments, and further, various modifications such as omissions and substitutions can be made thereto within a scope that does not deviate from the gist of the present invention. These embodiments and modifications thereof are included in the scope and gist of the invention described in the present disclosure, and are included in the invention described in the accompanying claims and the scope of equivalents thereof.

In the above embodiment, a virtual drum set D (refer to FIG. 1B) has been explained as a virtual percussion instrument to give an example; however, it is not limited thereto, and the present invention can be applied to other instruments such as a xylophone, which generates musical notes by down swing movements of the sticks 10.

What is claimed is:

1. A musical instrument comprising:

memory that stores layout information containing a plurality of regions arranged on a predetermined virtual plane and pitch angle ranges corresponding to each of the plurality of regions;

a pitch angle sensor that detects a pitch angle of a music playing member that can be held by a player during a music playing operation;

a position sensor that detects position coordinates of the music playing member on the virtual plane;

a first determination unit that determines whether the position coordinates of the music playing member belong to any of the plurality of regions arranged on the virtual plane based on the layout information stored in the memory, at a timing at which a music playing operation is made by way of the music playing member;

a second determination unit that determines, in a case of the first determination unit having determined as belonging to a region, whether the pitch angle of the music playing member detected by way of the pitch angle sensor belongs to a pitch angle range corresponding to the region; and a sound generation instruction unit that instructs generation of a sound of a musical note corresponding to the region, in a case of the second determination unit having determined as belonging to the pitch angle range corresponding to the region.

2. The musical instrument according to claim 1, wherein the position sensor includes an image-capturing device that captures an image in which the music playing member is a subject on a predetermined image-capturing plane, and detects the position coordinates of the music playing member with the image-capturing plane as the virtual plane.

3. The musical instrument according to claim 1, further comprising a notification unit that notifies the pitch angle of the music playing member at a timing at which the music playing operation is made by way of the music playing member.

4. The musical instrument according to claim 3, wherein the notification unit notifies the pitch angle of the music playing member in a case of the second determination unit not having determined as belonging to the pitch angle range.

5. The musical instrument according to claim 1, wherein the layout information further includes height data corresponding to a height when three-dimensionally displaying each of the plurality of regions, and wherein the musical instrument further comprises a display control unit that causes an arrangement of each of the plurality of regions on the image-capturing plane to be displayed in an arrangement display region of a predetermined display unit, and causes an image indicating a height when three-dimensionally displaying each of the plurality of regions to be displayed in a height display region of the display unit.

6. The musical instrument according to claim 5, further comprising a layout information adjustment unit that adjusts the arrangement of each of the plurality of regions of the layout information in the image-capturing plane, and the height of each of the plurality of regions of the layout information.

7. The musical instrument according to claim 6, further comprising a touch panel that detects a contact operation on the display unit, wherein the layout information adjustment unit includes:

an arrangement adjustment unit that adjusts a position of any of the plurality of regions on the image-capturing plane, in a case of having detected a contact operation on a screen of the arrangement display region, based on the contact position on the arrangement display region, and a position of each of the plurality of regions displayed on the arrangement display region; and a height adjustment unit that adjusts a position of an image indicating the height of any of the plurality of regions, in a case of having detected a contact operation on a screen of the height display region, based on the contact position on the height display region, and a position of an image indicating the height when three-dimensionally displaying each of the plurality of regions displayed on the height display region.

8. A method for a musical instrument that includes: memory that stores layout information containing a plurality of regions arranged on a predetermined virtual plane and pitch angle ranges corresponding to each of the plurality of regions; a pitch angle sensor that detects a pitch angle of a music playing member that can be held by a player during a music playing operation; and a position sensor that detects position coordinates of the music playing member on the virtual plane, the method comprising the steps of:

determining whether the position coordinates of the music playing member belong to any of a plurality of regions arranged on the virtual plane based on the layout information stored in the memory, at a timing at which a music playing operation is made by way of the music playing member;

determining, in a case of having determined as belonging to the region, whether the pitch angle of the music playing member detected by way of the pitch angle sensor belongs to a pitch angle range corresponding to the region; and instructing generation of a musical note corresponding to the region, in a case of having determined as belonging to the pitch angle region corresponding to the region.

9. The method according to claim 8, wherein the layout information further includes height data corresponding to a height when three-dimensionally displaying each of the plurality of regions, and wherein the method further comprises a step of displaying an arrangement of each of the plurality of regions on the image-capturing plane in an arrangement display region of a predetermined display unit, and displaying an image indicating the height when three-dimensionally displaying each of the plurality of regions in a height display region of the display unit.

10. The method according to claim 9, further comprising a step of adjusting the arrangement of each of the plurality of regions on the image-capturing plane in the layout information.

11. The method according to claim 10, wherein the musical instrument further includes a touch panel that detects a contact operation on the display unit, and wherein the method further comprises the steps of:

adjusting a position of any of the plurality of regions on the image-capturing plane, in a case of having detected a contact operation on a screen of the arrangement display region, based on the contact position on the arrangement display region, and a position of each of the plurality of regions displayed on the arrangement display region; and adjusting a position of an image indicating the height of any of the plurality of regions, in a case of having detected a contact operation on a screen of the height display region, based on the contact position on the height display region, and a position of an image indicating the height when three-dimensionally displaying each of the plurality of regions displayed on the height display region.

12. A computer readable recording medium used in a musical instrument having memory that stores layout information containing a plurality of regions arranged on a predetermined virtual plane and pitch angle ranges corresponding to each of the plurality of regions; a pitch angle sensor that detects a pitch angle of a music playing member that can be held by a player during a music playing operation; and a position sensor that detects position coordinates of the music playing member on the virtual plane, the recording medium encoded with a program that enables the computer to execute:

a first determining step of determining whether the position coordinates of the music playing member belong to any of a plurality of regions arranged on an image-capturing plane based on the layout information stored in the memory, at a timing at which a music playing operation is made by way of the music playing member;

a second determining step of determining, in a case of having determined in the first determining step as belonging to the region, whether the pitch angle of the music playing member detected by way of the pitch angle sensor belongs to a pitch angle range corresponding to the region; and a sound-generation instruction step of instructing generation of a musical note corresponding to the region, in a case of having determined in the second determining step as belonging to the pitch angle region corresponding to the region.

13. The recording medium according to claim 12, wherein the layout information further includes height data corresponding to a height when three-dimensionally displaying each of the plurality of regions, and wherein the recording medium is encoded with a program enabling the computer to further execute a step of displaying an arrangement of each of the plurality of regions on the image-capturing plane in an arrangement display region of a predetermined display unit, and displaying an image indicating the height when three-dimensionally displaying each of the plurality of regions in a height display region of the display unit.

14. The recording medium according to claim 13, encoded with a program enabling the computer to further execute a step of adjusting the arrangement of each of the plurality of regions on the image-capturing plane in the layout information.

15. The recording medium according to claim 14, wherein the musical instrument further includes a touch panel that detects a contact operation on the display unit, and wherein the step of adjusting includes:

adjusting a position of any of the plurality of regions on the image-capturing plane, in a case of having detected a contact operation on a screen of the arrangement display region, based on the contact position on the arrangement display region, and a position of each of the plurality of regions displayed on the arrangement display region; and adjusting a position of an image indicating the height of any of the plurality of regions, in a case of having detected a contact operation on a screen of the height display region, based on the contact position on the height display region, and a position of an image indicating the height when three-dimensionally displaying each of the plurality of regions displayed on the height display region.

* * * * *